US007977854B2

(12) United States Patent
Twesten et al.

(10) Patent No.: US 7,977,854 B2
(45) Date of Patent: Jul. 12, 2011

(54) COMPONENT FOR AN ELECTRIC LAMP WITH OUTER BULB

(75) Inventors: Karen Twesten, Berlin (DE); Sascha Piltz, Berlin (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 80 days.

(21) Appl. No.: 12/532,153

(22) PCT Filed: Feb. 29, 2008

(86) PCT No.: PCT/EP2008/052511

§ 371 (c)(1), (2), (4) Date: Sep. 20, 2009

(87) PCT Pub. No.: WO2008/119606

PCT Pub. Date: Oct. 9, 2008

(65) Prior Publication Data

US 2010/0102702 A1 Apr. 29, 2010

(30) Foreign Application Priority Data

Mar. 30, 2007 (DE) ..... 10 2007 015 483

(51) Int. Cl.
*H01J 1/02* (2006.01)

(52) U.S. Cl. ..... 313/25; 313/318.05

(58) Field of Classification Search ..... 313/17, 313/25, 318.05

See application file for complete search history.

(56) References Cited

U.S. PATENT DOCUMENTS

| | | | | |
|---|---|---|---|---|
| 2,092,206 | A * | 9/1937 | Dudding | 313/523 |
| 3,848,151 | A | 11/1974 | McVey | |
| 4,949,003 | A | 8/1990 | Cox et al. | |
| 4,973,881 | A | 11/1990 | Haraden et al. | |
| 6,600,267 | B1 | 7/2003 | Dotterweich et al. | |
| 7,439,662 | B2 | 10/2008 | Arndt et al. | |
| 2005/0253528 | A1 | 11/2005 | Schoeller et al. | |
| 2006/0091811 | A1 | 5/2006 | Schoeller et al. | |
| 2006/0197422 | A1 | 9/2006 | Hooker et al. | |
| 2006/0226754 | A1 | 10/2006 | Arndt et al. | |
| 2007/0052363 | A1 | 3/2007 | Schöller | |

FOREIGN PATENT DOCUMENTS

| | | | |
|---|---|---|---|
| CA | 2300741 | A1 | 9/2000 |
| DE | 19913297 | C1 | 4/2000 |
| EP | 0295592 | A2 | 12/1988 |
| EP | 1659617 | B1 | 2/2007 |
| WO | 2006131202 | A1 | 12/2006 |

OTHER PUBLICATIONS

English-language abstract for EP 0 295 592 A2, Dec. 21, 1988.
International Search Report for PCT/EP2008/052511 mailed on Jun. 2, 2008.

* cited by examiner

*Primary Examiner* — Vip Patel

(57) ABSTRACT

An assembly for an electric lamp with an elongated inner bulb, which is sealed at two ends, the inner bulb including a lamp axis, and a light-emitter being accommodated in the inner bulb, the inner bulb being surrounded by an outer bulb, wherein the outer bulb is substantially circular-cylindrical, and includes two parts, at least one part having a rounded-off, sealed first end, and the two parts each having an open second end, which ends are matched to one another in terms of diameter, and the parts being connected to one another in the region of the open end via a certain sealing path, the inner bulb being held in the outer bulb via two frame wires, which are passed out of the outer bulb between the two parts.

12 Claims, 5 Drawing Sheets

COMPONENT FOR AN ELECTRIC LAMP WITH OUTER BULB

RELATED APPLICATIONS

The present application is a national stage entry according to 35 U.S.C. §371 of PCT application No.: PCT/EP2008/052511 filed on Feb. 29, 2008, which claims priority from German application No.: 10 2007 015 483.8 filed on Mar. 30, 2007.

BACKGROUND

The invention is based on an assembly for an electric lamp with an outer bulb. Such lamps are for example high-pressure discharge lamps or halogen incandescent lamps.

WO-A 2006/0131202 describes a high-pressure discharge lamp with an outer bulb, in which lamp an outer bulb is connected to a bottom plate, which is used for passing through the power supply lines. The glass bulb is in this case designed with hard glass technology using aluminosilicate glass. As a result, a pinch seal in the outer bulb is dispensed with, and the length of the outer bulb is reduced.

EP-A 1 659 617 has disclosed equipping a high-pressure discharge lamp with an outer bulb which has a shortened pinch seal. In this case, a cavity is left between the two films in the pinch-sealing surface, which cavity contains the power supply line and part of the discharge vessel.

SUMMARY

Various embodiments provide an assembly for an electric lamp whose physical length is markedly reduced in comparison with conventional lamps, with the result that the construction of particularly compact light sources is made possible.

The assembly can either be equipped directly with a suitable base or it can preferably be used as a light-emitting means in a reflector lamp or luminaire.

A reduction in the axial length of an outer bulb is generally desirable for the miniaturization of electric lamps; this applies particularly to high-pressure discharge lamps such as metal-halide lamps. This aim is particularly important in the case of reflector lamps or modular lamps. For the integration of high-pressure discharge lamps with ceramic discharge vessels as light source in reflector and modular lamps, the total length of the high-pressure discharge lamp needs to be reduced. This is necessary, for example, in order to adhere to the standard lengths of the reflector lamps or modular lamps as described in principle in US-A 2006/226754 or in order to use smaller reflectors or in order to vary the light center and in order to make more space available for installation and fixing elements.

Various embodiments make it possible to reduce the outer bulb length in such a way that the outer bulb includes two parts, wherein the power supply lines are passed out of the outer bulb in the region of the joint between the two parts.

The two parts of the outer bulb are substantially circular-cylindrical and include quartz glass or vycor or high-melting hard glass. In this case, each cylinder has a sealed-off, rounded-off end and an open end for connection to one another. The open ends have a diameter which slightly differs from one another, with the result that the two ends overlap one another over a certain sealing path. The finished outer bulb is assembled via a fusing process by virtue of the two parts being connected to one another in the region of the sealing path. This can take place, for example, via a radial, annular shape, with a high inner pressure being applied to the outer bulb, if appropriate.

The two power supply lines are passed to the outside between the two open ends, i.e. in the center of the annular joint. In the case of an outer bulb made from hard glass, they can be passed directly towards the outside in one piece. In the case of quartz glass, it is more recommended that Mo foils are inserted between the two parts, with these foils being fixed in advance for example on the outer lining surface of the inner outer bulb part or for the annular outer lining surface of the inner, i.e. slightly smaller outer bulb part to be provided with a partial electrically conductive coating in order thus to realize the current bushing. The ends of the frame wires and power supply wires can likewise be fused directly into the fusible ring, for example by means of metallic lugs.

The fill in the outer bulb can optionally be a vacuum, nitrogen (50 mbar-800 mbar), argon (50 mbar-800 mbar) or air (atmospheric pressure, open system). The filling of the outer bulb can be performed once the joint has been produced via a cannula, which is later sealed, in the sealing path or via an exhaust tube, independently of the design of the sealing path, which exhaust tube is conventionally attached to one of the two parts of the outer bulb.

By joining two outer bulb parts together, the joining zone is moved from the conventional pinch-sealing region beneath the discharge vessel to the level of the discharge vessel, preferably the lower capillary. As a result, the total length of the lamp is reduced by this pinch-sealing region.

The power supply lines which are arranged outside the outer bulb can now preferably be moved away from one another over a full width of the outer bulb. This possibility is not provided in the case of conventional lamps since the power supply line always emerges within the one pinch seal. In addition, the frame wires in the outer bulb which hold the discharge vessel can be arranged very far apart from one another. Overall, a configuration is thus possible which allows for lamp operation at high starting voltages of markedly above 2 kV without any problems. The options of hot-restarting and rapid availability of light can therefore in principle be used.

Furthermore, the internal design of the lamp can be tailored in terms of size in a very flexible manner and depending on the required application.

In addition, the movement of the joint and the current bushing in the direction towards the lamp center or towards the center of the discharge vessel provides a further degree of freedom. This remarkably reduces the risk of thermal loading of the fuse seals on the discharge vessel.

A further advantage is the fact that the interface between the upper and the lower part of the outer bulb can be used as a reference edge both for the outer bulb fitting and for the installation in reflectors. The frame wires can be aligned and prefixed by virtue of suitable bending at this reference edge.

The concept proposed here can of course also be used in the case of halogen incandescent lamps, if said lamps have an outer bulb. In this case, an inner bulb is used instead of a discharge vessel.

Overall, the novel concept makes it possible to reduce the physical length of a lamp by an order of magnitude of 10 mm, which corresponds to an order of magnitude of approximately 15% in the case of a typical physical length of previously from 60 to 70 mm.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description various embodiments of the invention are described with reference to the following drawings, in which.

DETAILED DESCRIPTION

Figure 1:
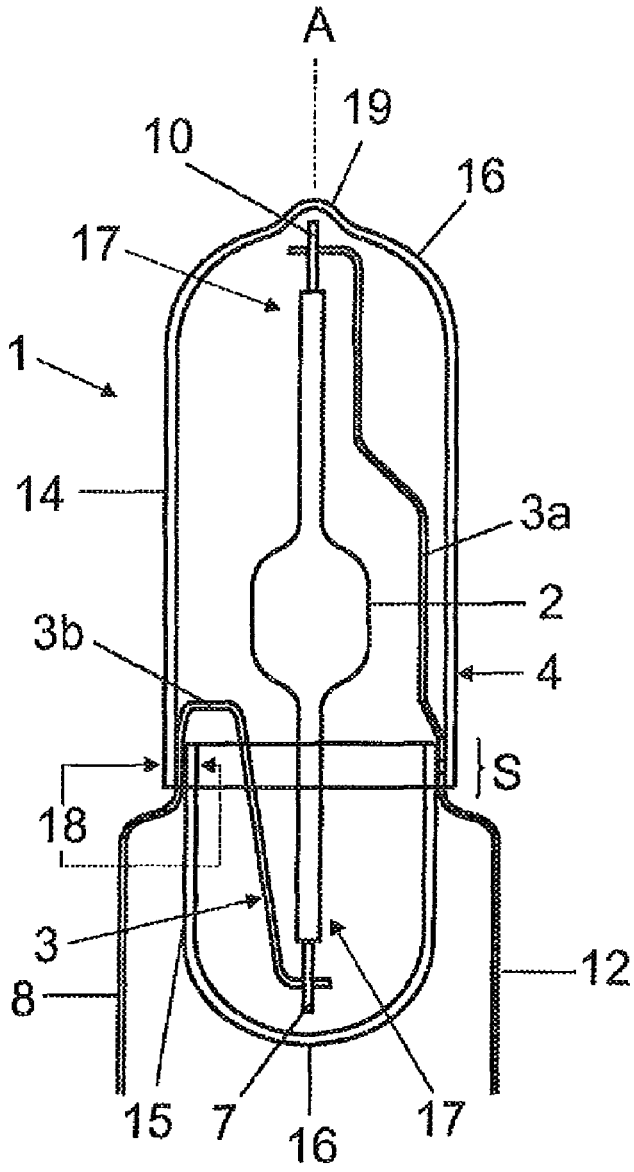
FIG. 1 shows a first exemplary embodiment of an assembly.

FIG. 1 shows an assembly 1. Said assembly includes a ceramic discharge vessel 2, which is held along a lamp axis A by a frame 3 with two wires 3*a*, 3*b* in an outer bulb 4 made from quartz glass. The outer bulb 4 includes two substantially circular-cylindrical parts 14 and 15. Both parts have a rounded-off end 16 in the vicinity of the ends 17 of the discharge vessel. However, the specific shape of these ends is not critical for the invention. Both parts also have an originally open circular-cylindrical end 18, which is sealed off when the outer bulb is finished over a certain sealing path S. One part of the outer bulb is the outer part 14 and either has a slightly greater inner diameter than the outer diameter of the other, inner part 15 or this relationship between the diameters which are matched to one another applies at least over the axial length S of the sealing path for two special join sections of the two parts, with the result that the inner part 15 can be fitted into the outer part 16 over the sealing path S and can then be fused, if appropriate. The electrical connection towards the outside is in this case produced either by virtue of a power supply line 3*b* being passed through between the two parts of the outer bulb, in particular by means of a suitable cutout, shown on the left in FIG. 1, or by means of a thin connecting pass, as shown on the right in the case of the power supply line 3*a*. Both possibilities can be used for both bushings 3*a*, 3*b*.

Figure 4:
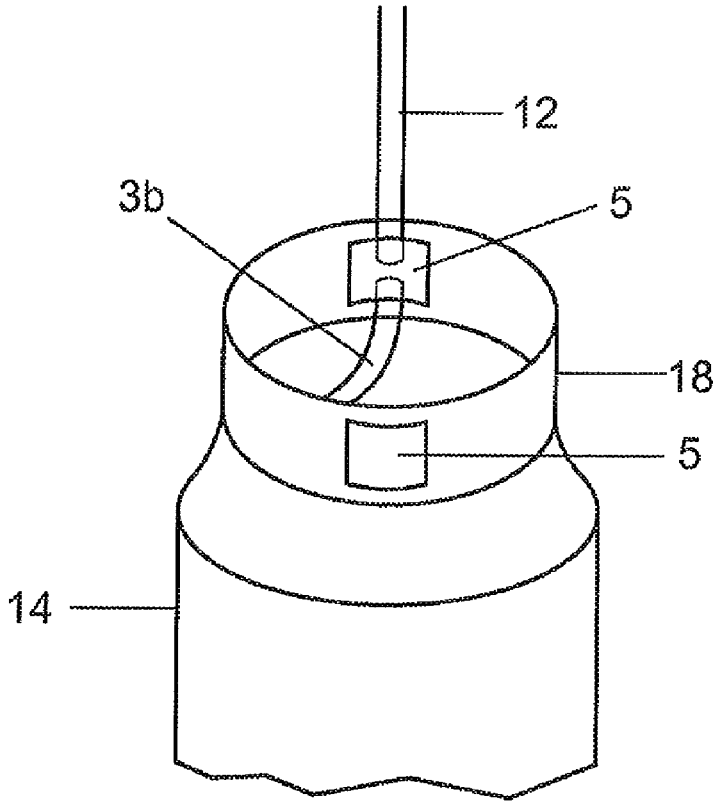
FIG. 4 shows an exemplary embodiment of a separate inner part.

The connection pass can in each case be in the form of a foil 5 (FIG. 4), which foils are each introduced between the two join sections in the region of the sealing path S.

Figure 5:
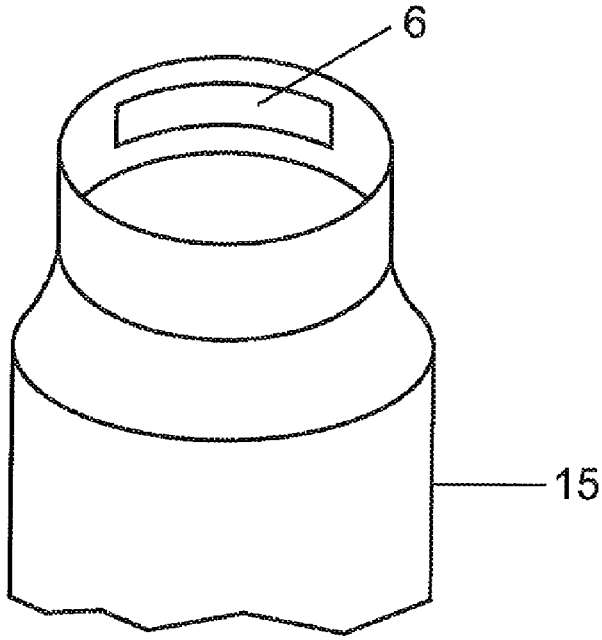
FIG. 5 shows an exemplary embodiment of a separate inner part.

Instead of the foil, the connection pass can also be an electrically conductive coating 6 applied in the form of a ring segment advantageously on the inner part 15, see FIG. 5.

The frame 3 (see FIG. 1) includes a first, usually shorter feed line 3*b*, which is bent approximately in the form of a U, and a second longer feed line 3*a*. The two feed lines are led up to the inner wall of the outer bulb. The short feed line 3*b* connects a first power supply line 7, which protrudes out of the first end of the discharge vessel, to an outer wire 8, which can also be integral with the feed line 3*b*, outside the outer bulb, possibly via a connecting pass such as a foil 5. The long feed line 3*a* connects a second power supply line 10, which protrudes out of the second end of the discharge vessel, to an outer wire 12 outside the outer bulb via a similar foil 5. The two outer wires 8 and 12 are routed parallel along the outer bulb.

In particular, cutouts for the feed lines and/or outer wires can also be provided in the region of the join sections.

The two parts 14, 15 of the outer bulb can only be inserted into one another, with air being used as the atmosphere in the outer bulb. However, they can also be hermetically sealed in the region of the join sections by virtue of heating and fusing of the glass or using a solder.

The discharge vessel has, for example, a fill consisting of metal halides, as is known per se. Furthermore, two electrodes are arranged in the discharge vessel, with the discharge arc being struck between said electrodes. However, a filament is also suitable as the light-emitting means.

The two parts 14, 15 are connected to one another approximately at the height of the first capillary 17 of the discharge vessel. The axial length of the two parts is then approximately equal in a rough approximation.

Advantageously, the two outer wires 8, 12 are passed out at mutually opposite sections of the outer bulb because in this case the probability of flashovers is at its lowest. However, this is not always absolutely necessary.

One of the two parts, in this case part 14, may have an exhaust tube 19, preferably in the vicinity of the sealed end, with the result that, in the case of a hermetic seal in the region of the join sections, the desired atmosphere can be introduced retrospectively into the outer bulb through the still open exhaust tube. A similar effect can also be provided by a cannula in the region of the join sections, with this cannula subsequently being sealed.

Figure 2:
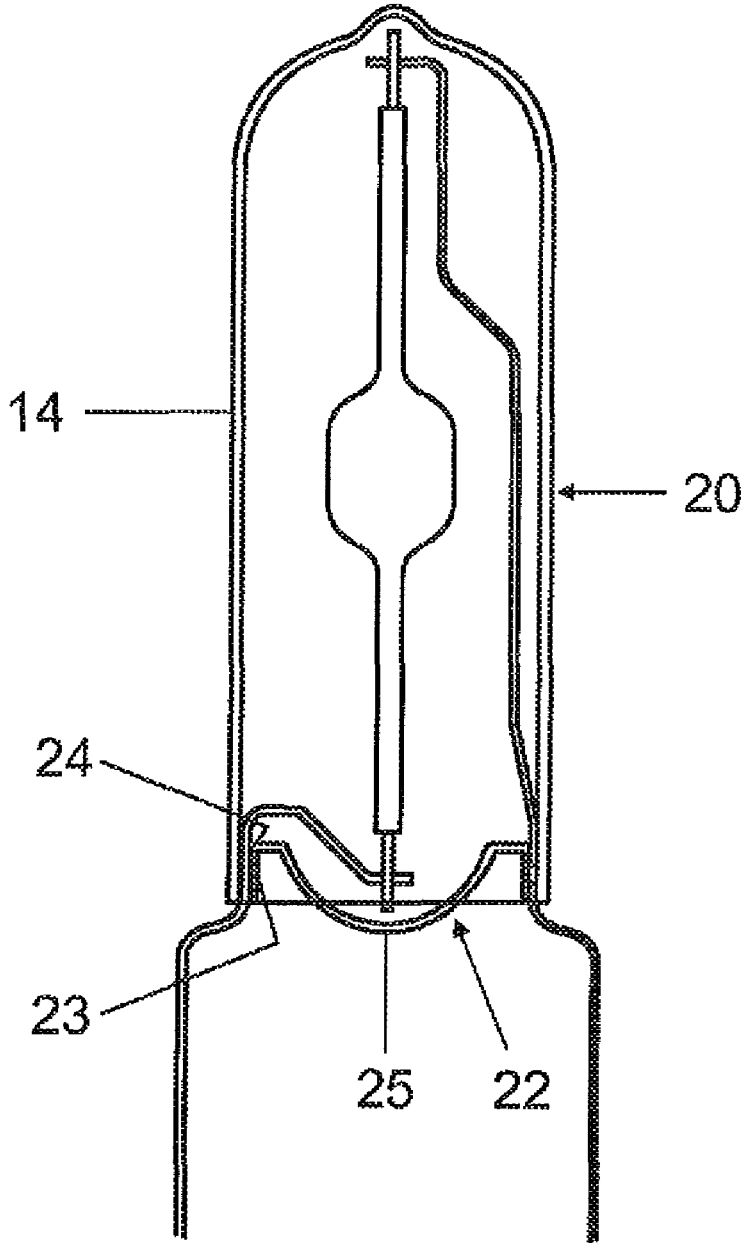
FIG. 2 shows a second exemplary embodiment of an assembly.

FIG. 2 shows an exemplary embodiment in which the outer bulb 20 likewise includes two parts. In this case, a first cylindrical part 14 is again drawn longitudinally in such a way that it virtually completely encases the inner vessel. The second part 22 is merely a cover part, which substantially only includes the annular join section 23, with a corrugated terminating part 25 covering the diameter of the ring at an edge, preferably at the inner edge 24. The terminating part 25 in this case attaches to the inner edge of the ring. The maximum degree of corrugation can in this case still be within the outer edge of the first part 14, but it may also end precisely at the height of the outer edge or slightly outside this area.

Figure 3:
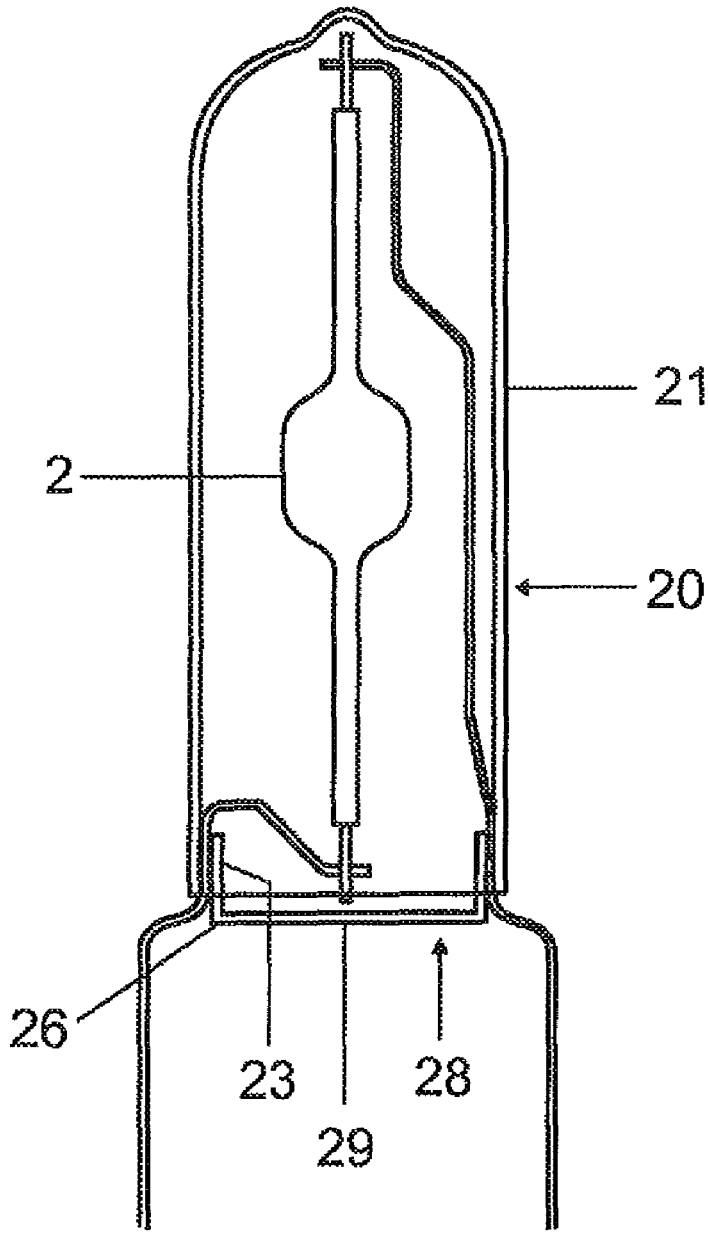
FIG. 3 shows an exemplary embodiment of a reflector lamp with an assembly.

The terminating part of the cover can also be a planar part 25. FIG. 3 shows an exemplary embodiment in which the outer bulb 20 includes two very different parts. In this case, a first cylindrical part 21 is drawn longitudinally in such a way that it virtually completely encases the inner vessel 2. The second part 28 is merely a cover part which substantially only includes the annular join section 23, with a plate-shaped terminating part 29 covering the diameter of the ring at an edge, preferably at the outer edge 26.

The assembly may also be based on an incandescent lamp. The fill in the inner volume is a conventional fill in the case of a filament as the light-emitting means, as described in EP-A 295 592, for example.

Figure 6:
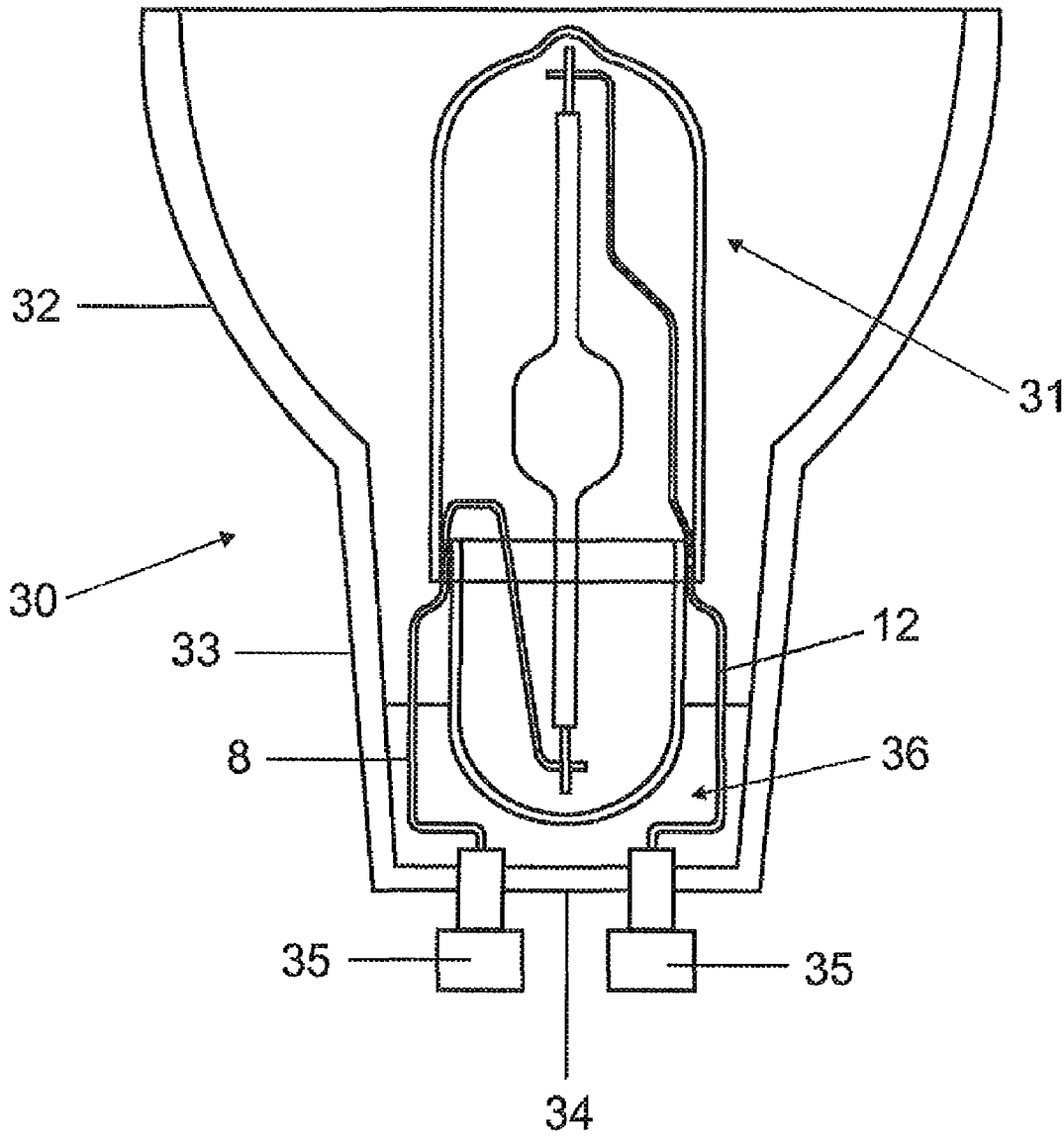
FIG. 6 shows an exemplary embodiment of a reflector lamp with an assembly.

FIG. 6 shows a complete reflector lamp 30. This includes an assembly 31 with a discharge vessel and an outer bulb, as described in FIG. 1, for example. This assembly is accommodated in a reflector as enveloping part, with the reflector having a concave front part 32 and a neck region 33, which ends in a terminating plate 34 as the bottom. Two contact pieces 35 are fastened in this plate 34. The outer wires 8, 12 of the assembly are passed to these contact pieces. The lower end of the assembly, which is arranged in the neck region, is fastened in the neck by means of cement 36. It is of course also possible for other fastening options to be used.

The invention claimed is:

1. An assembly for an electric lamp with an elongated inner bulb, which is sealed at two ends, the inner bulb comprising a lamp axis, and a light-emitter being accommodated in the inner bulb, the inner bulb being surrounded by an outer bulb, wherein the outer bulb is substantially circular-cylindrical, and comprises two parts, at least one part having a rounded-off, sealed first end, and the two parts each having an open second end, which ends are matched to one another in terms of diameter, and the parts being connected to one another in the region of the open end via a certain sealing path, the inner bulb being held in the outer bulb via two frame wires, which are passed out of the outer bulb between the two parts.

2. The assembly as claimed in claim 1, wherein the diameter of the two parts in the region of the sealing path differs slightly from one another.

3. The assembly as claimed in claim 1, wherein the material of the outer bulb comprises quartz glass, hard glass or vycor.

4. The assembly as claimed in claim 1, wherein at least one frame wire is passed directly to the outside in the region of the sealing path.

5. The assembly as claimed in claim 1, wherein at least one film is accommodated in the region of the sealing path.

6. The assembly as claimed in claim 1, wherein at least one electrically conducting coating is accommodated in the region of the sealing path.

7. The assembly as claimed in claim 1, wherein the light-emitter is an incandescent filament.

8. The assembly as claimed in claim 1, wherein the light-emitter is a discharge arc.

9. The assembly as claimed in claim 1, wherein the assembly comprising the inner bulb and the outer bulb is accommodated in an enveloping part.

10. A lamp, comprising:

an assembly for an electric lamp with an elongated inner bulb, which is sealed at two ends, the inner bulb comprising a lamp axis, and a light-emitter being accommodated in the inner bulb, the inner bulb being surrounded by an outer bulb, wherein the outer bulb is substantially circular-cylindrical, and comprises two parts, at least one part having a rounded-off, sealed first end, and the two parts each having an open second end, which ends are matched to one another in terms of diameter, and the parts being connected to one another in the region of the open end via a certain sealing path, the inner bulb being held in the outer bulb via two frame wires, which are passed out of the outer bulb between the two parts.

11. A luminaire, comprising:

an assembly for an electric lamp with an elongated inner bulb, which is sealed at two ends, the inner bulb comprising a lamp axis, and a light-emitter being accommodated in the inner bulb, the inner bulb being surrounded by an outer bulb, wherein the outer bulb is substantially circular-cylindrical, and comprises two parts, at least one part having a rounded-off, sealed first end, and the two parts each having an open second end, which ends are matched to one another in terms of diameter, and the parts being connected to one another in the region of the open end via a certain sealing path, the inner bulb being held in the outer bulb via two frame wires, which are passed out of the outer bulb between the two parts.

12. The assembly as claimed in claim 9, wherein the assembly comprising the inner bulb and the outer bulb is accommodated in a reflector or in a further bulb.

* * * * *